US011655634B2

(12) United States Patent
Bixel

(10) Patent No.: US 11,655,634 B2
(45) Date of Patent: May 23, 2023

(54) ACOUSTIC PANELS AND RELATED METHODS

(71) Applicant: Nut Shell LLC, Redmond, WA (US)

(72) Inventor: Douglas Allan Bixel, Redmond, WA (US)

(73) Assignee: Nut Shell LLC, Redmond, WA (US)

( * ) Notice: Subject to any disclaimer, the term of this patent is extended or adjusted under 35 U.S.C. 154(b) by 42 days.

(21) Appl. No.: 17/348,485

(22) Filed: Jun. 15, 2021

(65) Prior Publication Data

US 2021/0396009 A1 Dec. 23, 2021

Related U.S. Application Data

(60) Provisional application No. 63/144,286, filed on Feb. 1, 2021, provisional application No. 63/040,197, filed on Jun. 17, 2020.

(51) Int. Cl.
*E04B 9/04* (2006.01)

(52) U.S. Cl.
CPC ..... *E04B 9/0478* (2013.01); *E04B 9/0414* (2013.01); *E04B 9/0435* (2013.01); *E04B 9/0464* (2013.01)

(58) Field of Classification Search
CPC .... E04B 9/0478; E04B 9/0414; E04B 9/0435; E04B 9/0464
See application file for complete search history.

(56) References Cited

U.S. PATENT DOCUMENTS

| | | | | | |
|---|---|---|---|---|---|
| 3,998,014 | A * | 12/1976 | Bartels | E04B 9/0464 | 206/322 |
| 4,696,142 | A * | 9/1987 | Mieyal | E04B 9/26 | 52/506.08 |
| 5,077,949 | A * | 1/1992 | Kotter | E01F 8/007 | 52/630 |
| 10,145,104 | B1 * | 12/2018 | Winn | E04B 2/7863 | |
| 2008/0086962 | A1 * | 4/2008 | Jahn | E04B 9/26 | 52/489.1 |
| 2011/0146183 | A1 * | 6/2011 | Wilkens | E04B 9/0414 | 52/631 |
| 2015/0121772 | A1 * | 5/2015 | Berken | E04B 2/7405 | 52/28 |

FOREIGN PATENT DOCUMENTS

| | | | | |
|---|---|---|---|---|
| DE | 3405864 | A1 * | 2/1985 | |
| GB | 1383859 | A * | 2/1975 | E04B 1/86 |
| WO | WO-2004106654 | A2 * | 12/2004 | E04B 9/001 |

* cited by examiner

*Primary Examiner* — Theodore V Adamos
(74) *Attorney, Agent, or Firm* — Dorsey & Whitney LLP

(57) ABSTRACT

Acoustic panels are disclosed herein. The acoustic panels can include a base, a plurality of sidewalls, a plurality of hinges, and a plurality of connection interfaces. The acoustic panels can include an unassembled configuration in which the acoustic panels are substantially planar or flat. Prior to installation, the acoustic panels can be transitioned to an assembled configuration by folding the sidewalls. The acoustic panels can be coupled to a building structure, such as a ceiling, wall, or suspension system.

20 Claims, 10 Drawing Sheets

ACOUSTIC PANELS AND RELATED METHODS

CROSS-REFERENCE TO RELATED APPLICATIONS

This application claims priority to U.S. Provisional Application No. 63/040,197, filed Jun. 17, 2020, and titled ACOUSTIC PANELS AND RELATED METHODS, and U.S. Provisional Application No. 63/144,286, filed Feb. 1, 2021, and titled ACOUSTIC PANELS AND RELATED METHODS, each of which is hereby incorporated by reference in its entirety.

TECHNICAL FIELD

The present disclosure relates generally to the field of acoustic systems for absorbing sound energy. More particularly, some embodiments relate to acoustic panels that absorb sound energy in a building structure.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
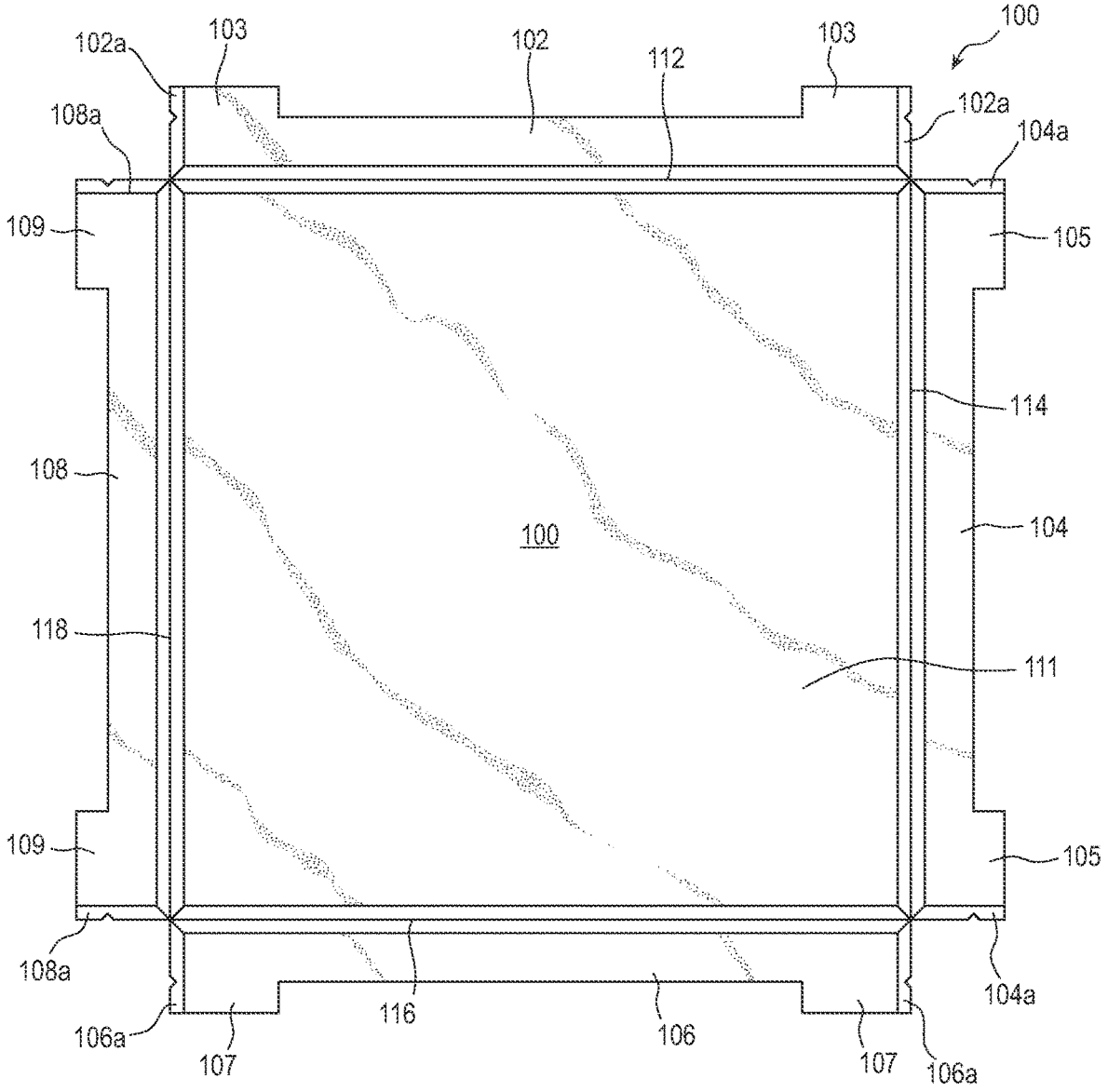
FIG. 1 is a plan view of a first side of an acoustic panel, depicted in an unassembled configuration.

Many locations are filled with various sources of sound and/or noise, including people, vehicles, music players, computers, televisions, appliances, musical instruments, etc. These sounds may cause confusions, strain, anxiety, privacy concerns, and/or miscommunication. Accordingly, sound dampening and/or acoustic materials may be used to absorb, dampen, reflect, etc., sound energy in an attempt to control the sound in a desired manner.

The present disclosure relates to acoustic panels used to absorb, dampen, and/or reflect sound energy in an acoustic system. In some embodiments, the acoustic panels can be applied to a building structure, such as a ceiling, wall, or suspension system. As further detailed below, the embodiments may be best understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments is not intended to limit the scope of the disclosure, but is merely representative of possible embodiments of the disclosure. In some cases, well-known structures, materials, or operations are not shown or described in detail. While the various aspects of the embodiments are presented in drawings, the drawings are not necessarily drawn to scale unless specifically indicated.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method. Furthermore, the terms "comprise," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The phrase "coupled to" is broad enough to refer to any suitable coupling or other form of interaction between two or more entities, including mechanical interaction. Two components may be coupled to each other even though they are not in direct contact with each other. Objects described herein as being "adjacent" to each other may be in physical contact with each other, in close proximity to each other, or in the same general region or area as each other, as appropriate for the context in which the phrase is used.

Figure 2:
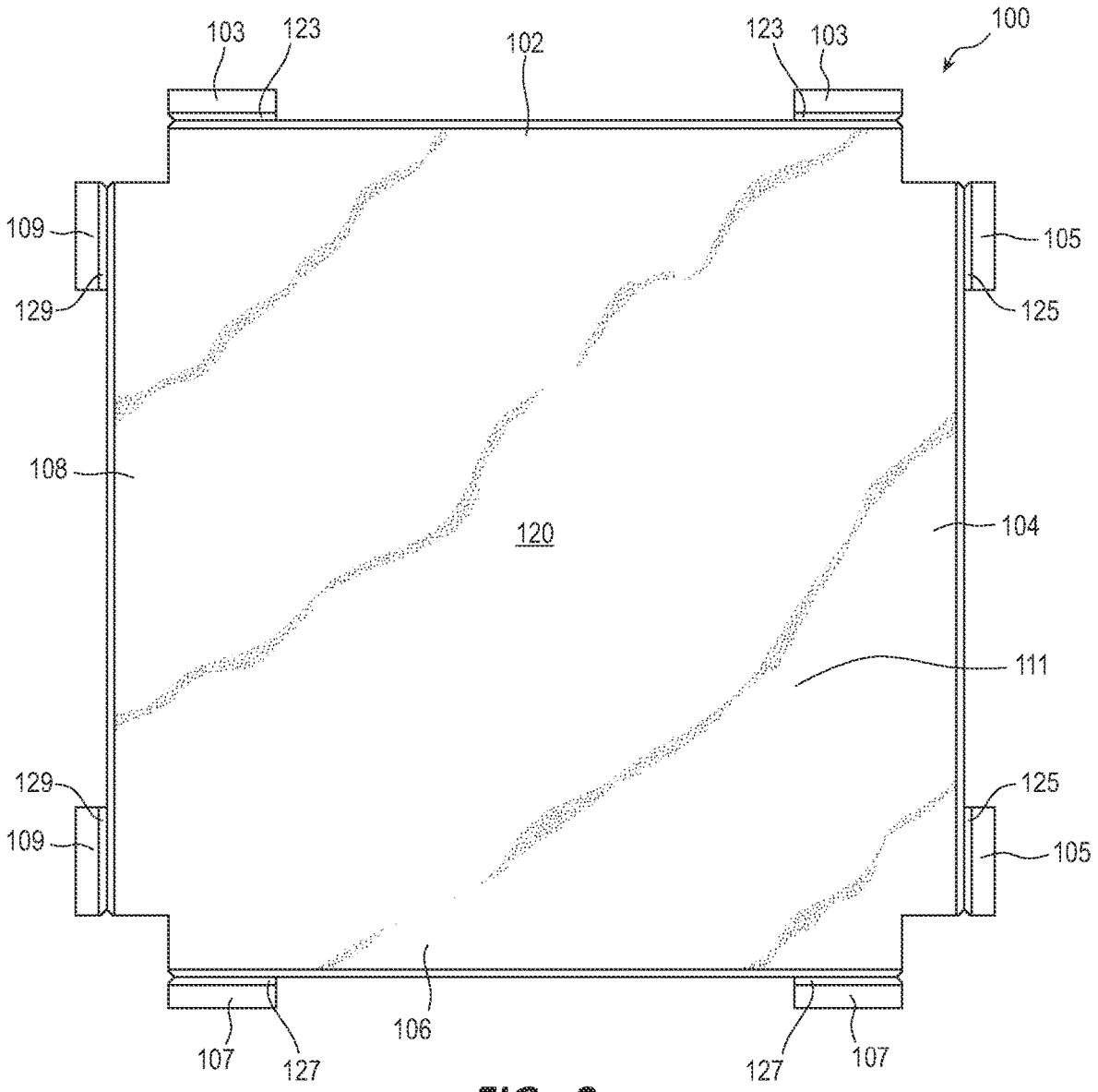
FIG. 2 is a plan view of a second side of the acoustic panel of FIG. 1, depicted in an unassembled configuration.
Figure 3:
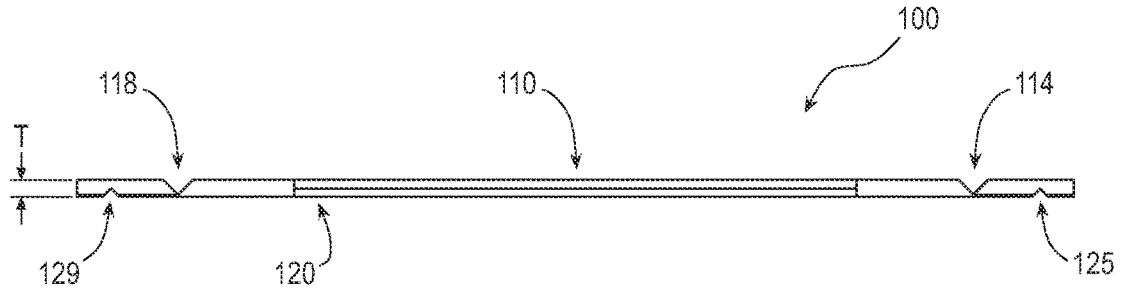
FIG. 3 is a side view of the acoustic panel of FIG. 1, depicted in an unassembled configuration.
Figure 4:
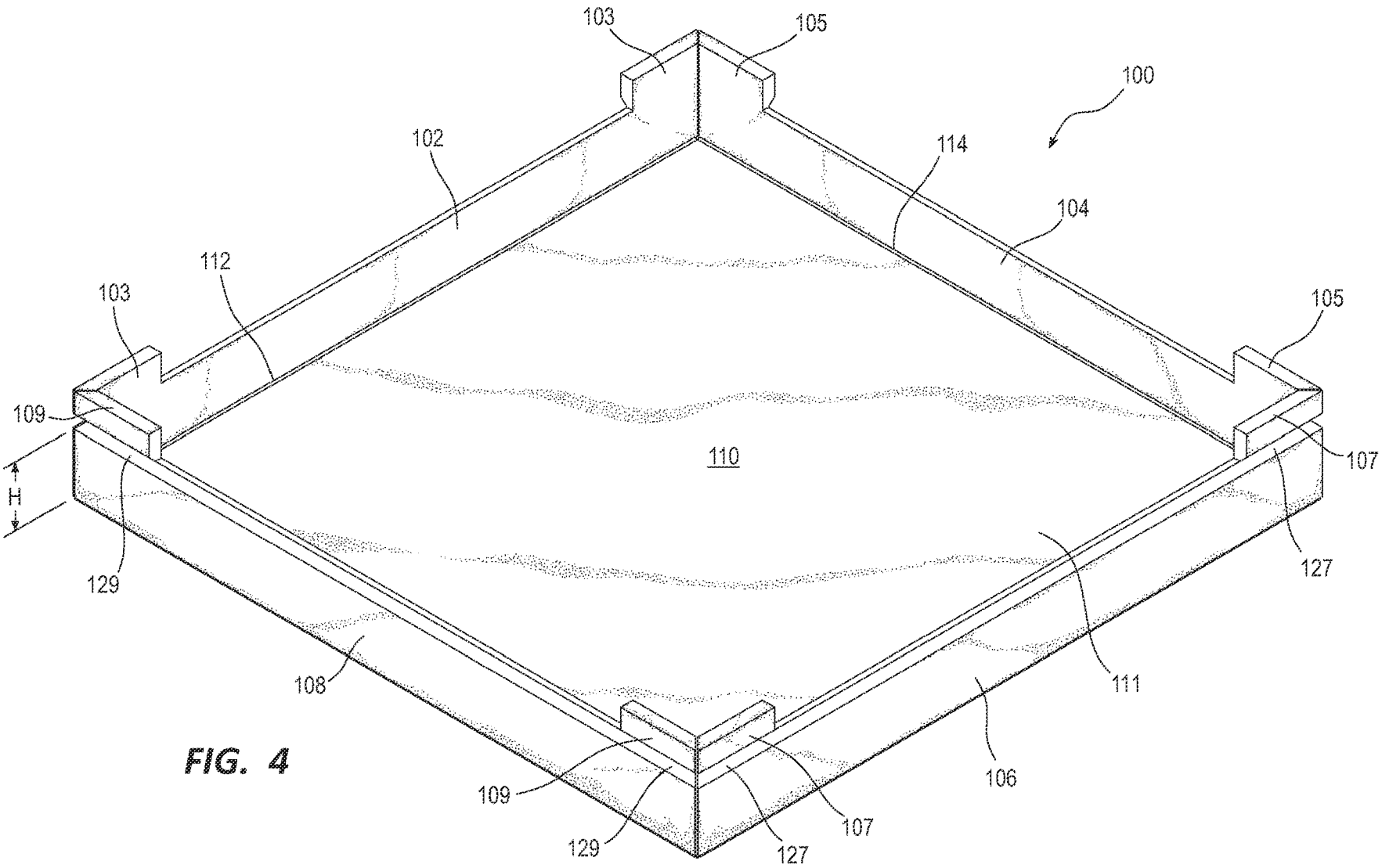
FIG. 4 is a perspective view of the first side of the acoustic panel of FIG. 1, depicted in an assembled configuration.

FIGS. 1-4 illustrate various views of an acoustic panel 100 in accordance with an embodiment of the present disclosure. In particular, FIG. 1 illustrates a plan view of a first side of the acoustic panel 100 in an unassembled configuration; FIG. 2 illustrates a plan view of a second side of the acoustic panel 100 in an unassembled configuration; FIG. 3 illustrates a side view of the acoustic panel 100 in an unassembled configuration; and FIG. 4 illustrates a perspective view of a first side of the acoustic panel 100 in an assembled configuration. As can be appreciated, an unassembled configuration or state can also be referred to as an unfolded configuration or state, and an assembled configuration or state can also be referred to as a folded configuration or state.

As shown in FIGS. 1-3, the acoustic panel 100 is substantially planar or flat in an unassembled configuration. This substantially planar or flat shape is advantageous in many ways. For instance, a substantially planar or flat shape can yield various advantages when packaging, shipping, and/or storing the acoustic panels 100. For example, a substantially planar or flat shape can take up significantly less space and volume than a non-planar and non-flat shape. Manufacturing steps can also be minimized as the acoustic panel 100 may be assembled prior to installation rather than prior to shipment. The acoustic panel 100 may also be assembled without use of an adhesive (e.g., glue) or other hardware, as further detailed below.

The acoustic panel 100 includes a base 111 or central region. The acoustic panel 100 further includes a plurality of sidewalls 102, 104, 106, 108 extending around a periphery of the base 111. In the illustrated embodiment, the acoustic panel 100 includes four sidewalls 102, 104, 106, 108. In other embodiments, the acoustic panel 100 includes a number of sidewalls that corresponds to the number of edges around the panel 100. For example, a triangular shaped panel can include 3 sidewalls, a pentagonal shaped panel can include 5 sidewalls, and hexagonal shaped panel can include 6 sidewalls, etc. Other shapes and numbers of sidewalls are also contemplated.

The acoustic panel 100 further includes a plurality of hinges 112, 114, 116, 118 that extend around the periphery of the base 111. As shown in the illustrated embodiment, the hinges 112, 114, 116, 118 can be disposed between the base 111 and the sidewalls 102, 104, 106, 108. In some embodiments, the hinges 112, 114, 116, 118 are living hinges made of the same material as the base 111 and sidewalls 102, 104, 106, 108. In some of such embodiments, the base 111, hinges 112, 114, 116, 118, and sidewalls 102, 104, 106, 108 are made of a unitary piece of material. For instance, the hinges 112, 114, 116, 118 can be formed by cutouts in the material and/or structure. In other embodiments, individual hinge structures 112, 114, 116, 118 can be used to couple individual sidewall structures 102, 104, 106, 108 to the base 111.

With reference to FIG. 1, the hinges 112, 114, 116, 118 can extend along a length of each side of the base 111. Further, the hinges 112, 114, 116, 118 can extend the entirety of the length of each side of the base 111 and define a folding region wherein the sidewalls 102, 104, 106, 108 can fold. For instance, the hinges 112, 114, 116, 118 can be configured such that the sidewalls 102, 104, 106, 108 can be folded to transition from an unassembled configuration (as shown in FIGS. 1-3) to an assembled configuration (as shown in FIG. 4). For example, prior to installation and/or at a user's discretion, the sidewalls 102, 104, 106, 108 can be folded along the hinges 112, 114, 116, 118 to transition the acoustic panel 100 from the unassembled configuration (as shown in FIGS. 1-3) to the assembled configuration (as shown in FIG. 4).

With reference to FIGS. 1-3, the hinges 112, 114, 116, 118 are disposed on a first side 110 of the acoustic panel 100. For instance, the hinges 112, 114, 116, 118 can comprise cutouts in the first side 110 of the acoustic panel 100. In such embodiments, the sidewalls 102, 104, 106, 108 are configured to fold approximately 90 degrees in one direction, towards the first side 110. In other embodiments, bidirectional hinges 112, 114, 116, 118 can be used such that the sidewalls 102, 104, 106, 108 can be forded towards either the first side 110 or the second side 120. For instance, cutouts can be formed on both sides 110, 120 of the acoustic panel 100 to achieve bidirectional hinges 112, 114, 116, 118 if desired.

In some embodiments, the hinges 112, 114, 116, 118 can comprise a substantially v-shaped cross-sectional cutout shape, as shown in FIG. 3. In certain of such embodiments, the walls of the hinges 112, 114, 116, 118 can be disposed at an angle of between about 40 and about 50 degrees relative to the longitudinal plane of the acoustic panel 100. In one embodiment, the walls of the hinges 112, 114, 116, 118 are disposed at an angle of about 45 degrees relative to the longitudinal plane of the acoustic panel 100. When the sidewalls 102, 104, 106, 108 are folded (e.g., approximately 90 degrees) and transitioned to the assembled configuration, the opposing walls of the hinges 112, 114, 116, 118 can be configured to contact and/or interface with one another. With the opposing walls of the hinges 112, 114, 116, 118 disposed adjacent one another, the sidewalls 102, 104, 106, 108 are oriented in a substantially perpendicular orientation relative to the panel 100 as shown in FIG. 4.

As further shown in the illustrated embodiment, edges 102*a*, 104*a*, 106*a*, 108*a* of the sidewalls 102, 104, 106, 108 can also be cut or shaped with an angled or sloped surface. The edges 102*a*, 104*a*, 106*a*, 108*a* can further be configured to correspond and interface with an edge 102*a*, 104*a*, 106*a*, 108*a* of an adjacent sidewall 102, 104, 106, 108 when folded or assembled, as shown in FIG. 4.

As further shown in FIGS. 1-4, the sidewalls 102, 104, 106, 108 further include one or more extension members 103, 105, 107, 109 and one or more connection interfaces 123, 125, 127, 129. The extension members 103, 105, 107, 109 and/or connection interfaces 123, 125, 127, 129 can be configured to aid in coupling the panel 100 to a building structure.

In some embodiments, the connection interfaces 123, 125, 127, 129 include a recess, channel, or groove formed in the sidewall 102, 104, 106, 108. As shown in the illustrated embodiment, the connection interfaces 123, 125, 127, 129 are also disposed towards the second side 120 of the panel 100, or the side opposite the hinges 112, 114, 116, 118 such that the connection interfaces 123, 125, 127, 129 are directed outward when the sidewalls 102, 104, 106, 108 are folded into the assembled configuration. The connection interfaces 123, 125, 127, 129 are also disposed at an upper edge of the sidewalls 102, 104, 106, 108, below the extension members. As further detailed below, the connection interface 123, 125, 127, 129 can be configured to receive a portion of a building structure (e.g., a runner or rail) to couple the acoustic panel 100 to a building structure. The connection interface 123, 125, 127, 129 can further extend along a portion of or the entirety of the sidewall 102, 104, 106, 108, as shown in FIG. 4.

The acoustic panel 100 illustrated in FIGS. 1-4 is substantially rectangular in shape. However, the disclosure is not so limited, and the acoustic panel 100 can be other shapes and configurations as desired. For instance, in one embodiment the acoustic panel 100 is rectangular in shape, having pairs of sidewalls 102, 104, 106, 108 with varying lengths. Other shapes are also contemplated.

Figure 8:
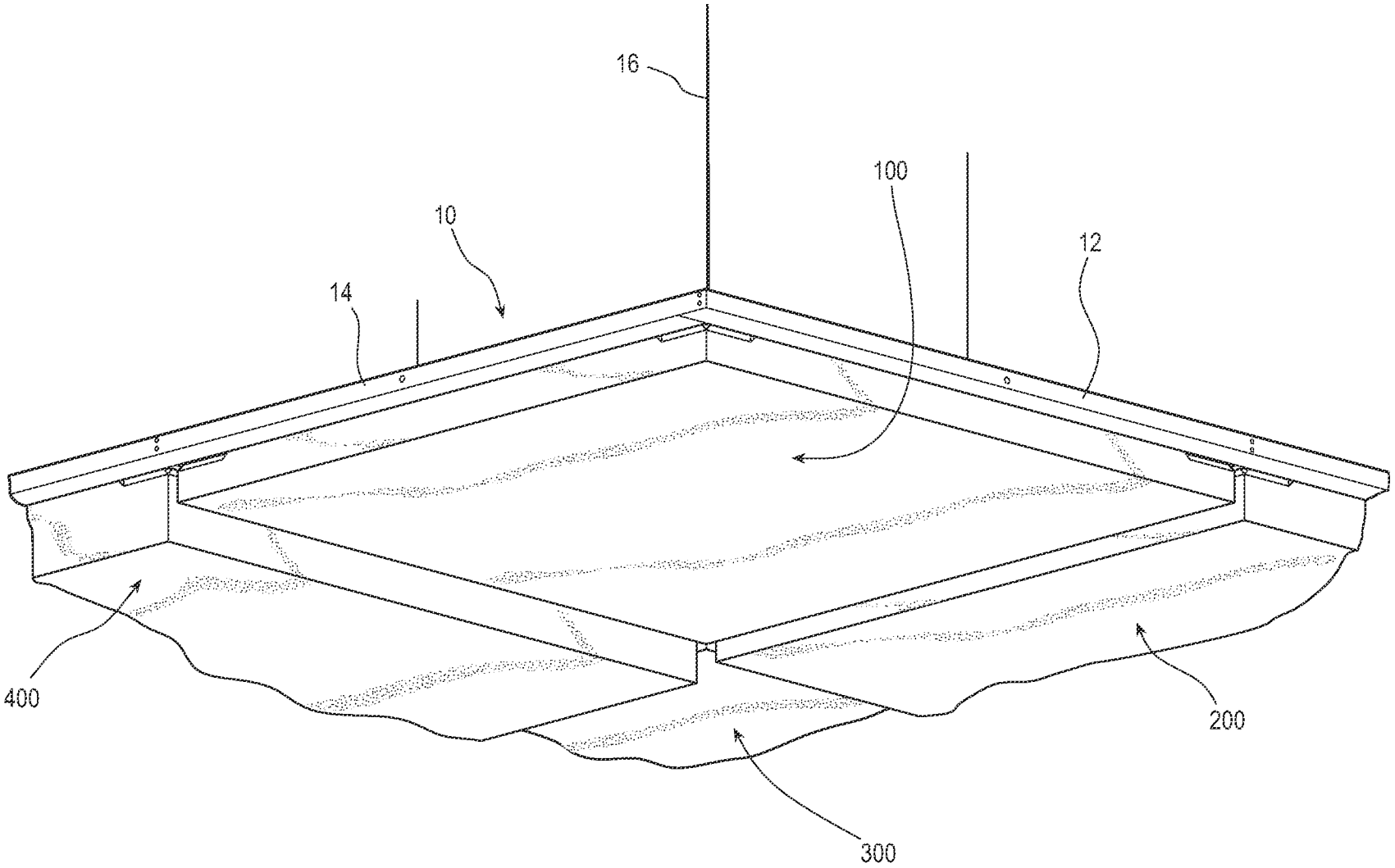
FIG. 8 is a perspective view of an acoustic system with a plurality of acoustic panels coupled to a suspension system.

The size of the acoustic panel 100 may also vary as desired. For example, in some embodiments, the thickness T of the base 111 of the acoustic panel 100 is between about ⅛ inch and about 2 inches, or between about ¼ inch and about 1 inch. When assembled, the height H of the acoustic panel 100 can also vary as desired. For example, in some embodiments, the height H of the acoustic panel 100 is between about 1 inch and about 24 inches, between about 1 inch and about 20 inches, or between about 1 inch and about 12 inches. Further, in some instances, the height H of the acoustic panels 100 vary within a system. For example, various acoustic panels 100 can be used having various heights (as shown in FIG. 8). When assembled, the length and/or width of the acoustic panel 100 may also vary. In some embodiments, the length and/or width of the acoustic panel 100 is between about 5 inches and about 96 inches, or between about 10 inches and about 48 inches. Other heights H, thicknesses T, lengths and/or widths are also contemplated.

As previously discussed, the acoustic panels 100 may be coupled to a building structure, such as a ceiling, wall, or suspension system to absorb, dampen, and/or reflect sound energy. Each acoustic panel 100 may comprise various types of sound dampening materials. Exemplary sound dampening materials that can be used include, but are not limited to, cotton, rayon, acetate, nylon, wood, olefins (or polyolefins), polyesters, acrylics, fiberglass, petroleum based fibers, bio-fibers (e.g., fibers manufactured from soybean oil, corn oil, sugar cane, bamboo, etc.) and mixtures thereof. In certain embodiments, the acoustic panel 100 comprises polyester and/or fiberglass. In a particular embodiment, the acoustic panel 100 comprises polyester. And in another particular embodiment, the acoustic panel 100 comprises fiberglass. In certain embodiments, the sound dampening material is fibrous. For example, the acoustic panel 100 may comprise fiberglass, a spunbonded olefin, or a spunbonded polyester sound dampening material. In some embodiments, the fibrous material can also be an extruded fibrous material.

The sound dampening material of the acoustic panel 100, and/or layers of the acoustic panel 100, can also be non-woven. Non-woven materials can be useful in acoustic sound control due to their porous structure, high surface area, and low cost of production. The non-woven materials may also be porous. For example, non-woven materials can have a porosity greater than 70%, 80%, or 90%. This porosity can increase the amount of sound energy the acoustic panel 100 may absorb.

In some embodiments, the acoustic panel 100 comprises mixtures of different types of sound dampening materials (such as mixtures of different types of polyesters). For example, the acoustic panel 100 can comprise a high melt material and a low melt material (e.g., such as high and low melt polyesters). High melt materials can refer to materials having a melting point greater than about 330° F., such as between about 330° F. and about 450° F. Low melt materials can refer to materials having a melting point lower than about 320° F., such as between 220° F. and about 320° F. For instance, in a particular embodiment, the acoustic panel 100 comprises a mixture of at least one high melt polyester having a melting point greater than about 330° F., such as between about 330° F. and about 450° F., and at least one low melt polyester having a melting point lower than about 320° F., such as between 220° F. and about 320° F. In some of these embodiments, the acoustic panel 100 may comprise between about 50% and 95%, or between about 70% and 90% by weight of a high melt material, and between about 5% and 50%, or between about 10% and 30% by weight of a low melt material.

The acoustic panel 100 may also comprise acoustic materials having various weights, thicknesses, or deniers. For example, in certain embodiments, the acoustic materials can comprise a first portion of fibers having a first average denier and a second portion of fibers having a second average denier. In some of such embodiments, the first average denier is smaller than the second average denier. Additional sizes, such as a third average denier, fourth average denier, etc., can also be used.

In some embodiments, the acoustic panel 100 can comprise a plurality of layers that are fabricated into a mat. In some of such embodiments, fabrication of the acoustic panel 100 comprises disposing acoustic material into two or more layers. The acoustic material can then be treated. For example, the acoustic material can be compressed and/or subjected to heat or elevated temperatures, such as with a hot iron or heat press to form a mat. Other manufacturing methods and/or processes can also be used. For example, in some embodiments, acoustic materials can be entangled within a layer. Entanglement can occur prior to laying the adjacent layer (e.g., second layer) or after laying the adjacent layer.

As previously indicated, the acoustic panel 100 may be configured to absorb, dampen, and/or reduce acoustic energy. In some embodiments, the acoustic panel 100 may reduce acoustic energy by at least 20%, at least 30%, at least 40%, at least 50%, at least 60%, at least 70%, at least 80%, or at least 90%. In other embodiments, the acoustic panel 100 may reduce acoustic energy in an amount ranging from 50% to 90%. The standard for measuring such a reduction of acoustic energy may be a Noise Reduction Coefficient (NRC) as tested under ASTM C423.

Figure 5:
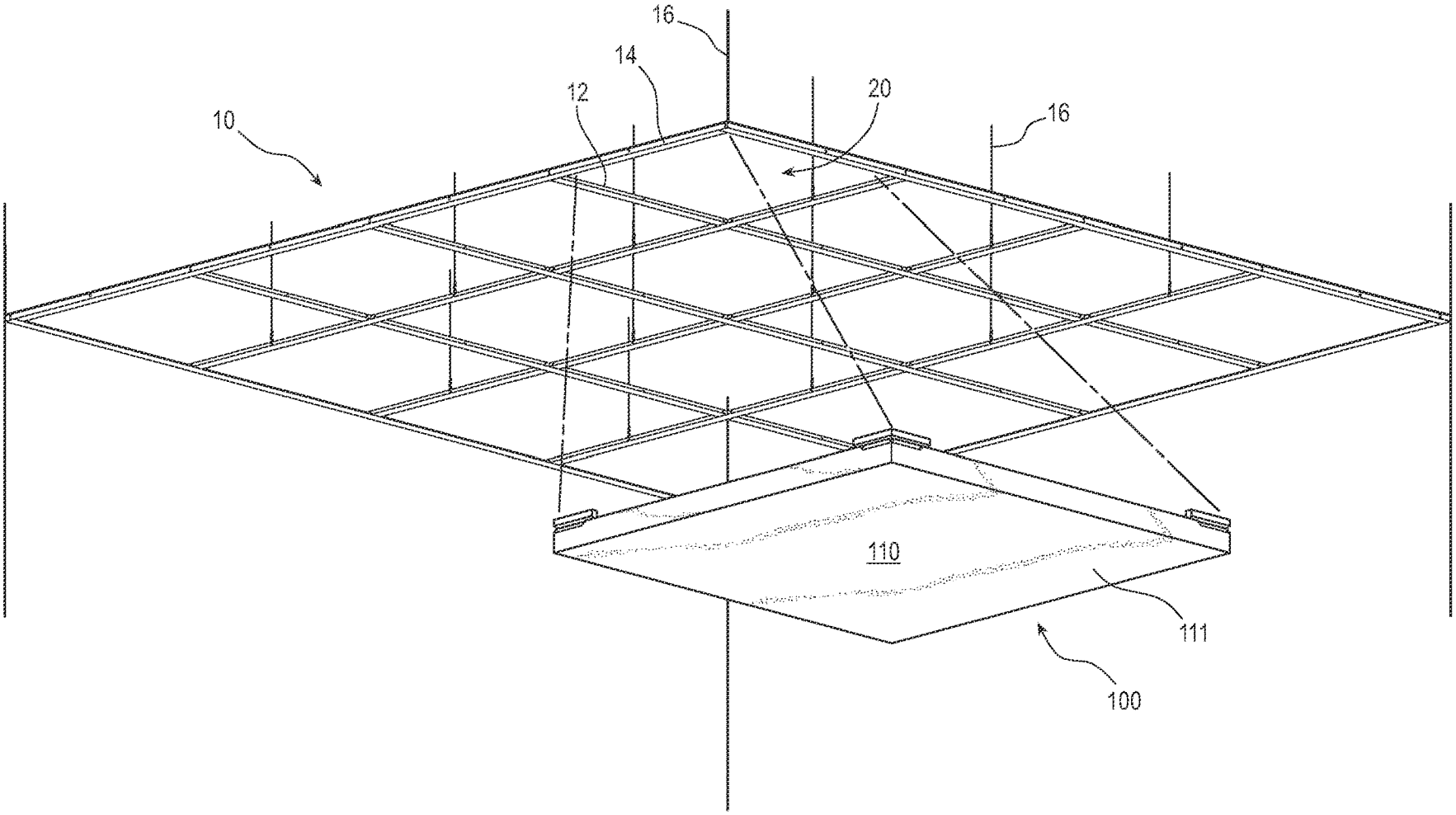
FIG. 5 is a perspective view of an acoustic system that can include a suspension system and an acoustic panel.

The acoustic panel 100 can be coupled to various types of building structures. For instance, the acoustic panels 100 can be coupled to ceiling, wall, or suspension system. The mounting of an acoustic panel 100 to an exemplary suspension system 10 is shown in FIG. 5. For example, in FIG. 5, the suspension system 10 includes a plurality of rails or runners 12 extending in a first direction and a plurality of rails or runners 14 extending in a second direction to form a grid with a plurality of openings 20 sized to receive acoustic panels 100. The dimensions of the grid can vary, such as between about 2 feet and about 20 feet, or between about 2 feet and about 12 feet. Larger and/or smaller grids are also contemplated. The size of the openings 20 in the grid can also vary, such as between about 5 inches and about 96 inches, or between about 10 inches and about 48 inches. The openings 20 can also be rectangular or square in accordance with the grid design.

As further shown in FIG. 5, the rails or runners 12, 14 of the grid may be suspended and/or hung from a ceiling or wall structure. For instance, in the illustrated embodiment, the rails or runners 12, 14, are suspended by a plurality of suspension wires or cables 16. The suspension wires or cables 16 can support the rails or runners 12, 14 at a predetermined distance from a ceiling. In other instances, the rails or runners 12, 14 are suspended by one or more wall structures (e.g., between two or more wall structures extending vertically from a floor structure). In other embodiments, the acoustic panels 100 can be coupled directed to a wall or ceiling structure which may have a grid-like interface.

Figure 6:
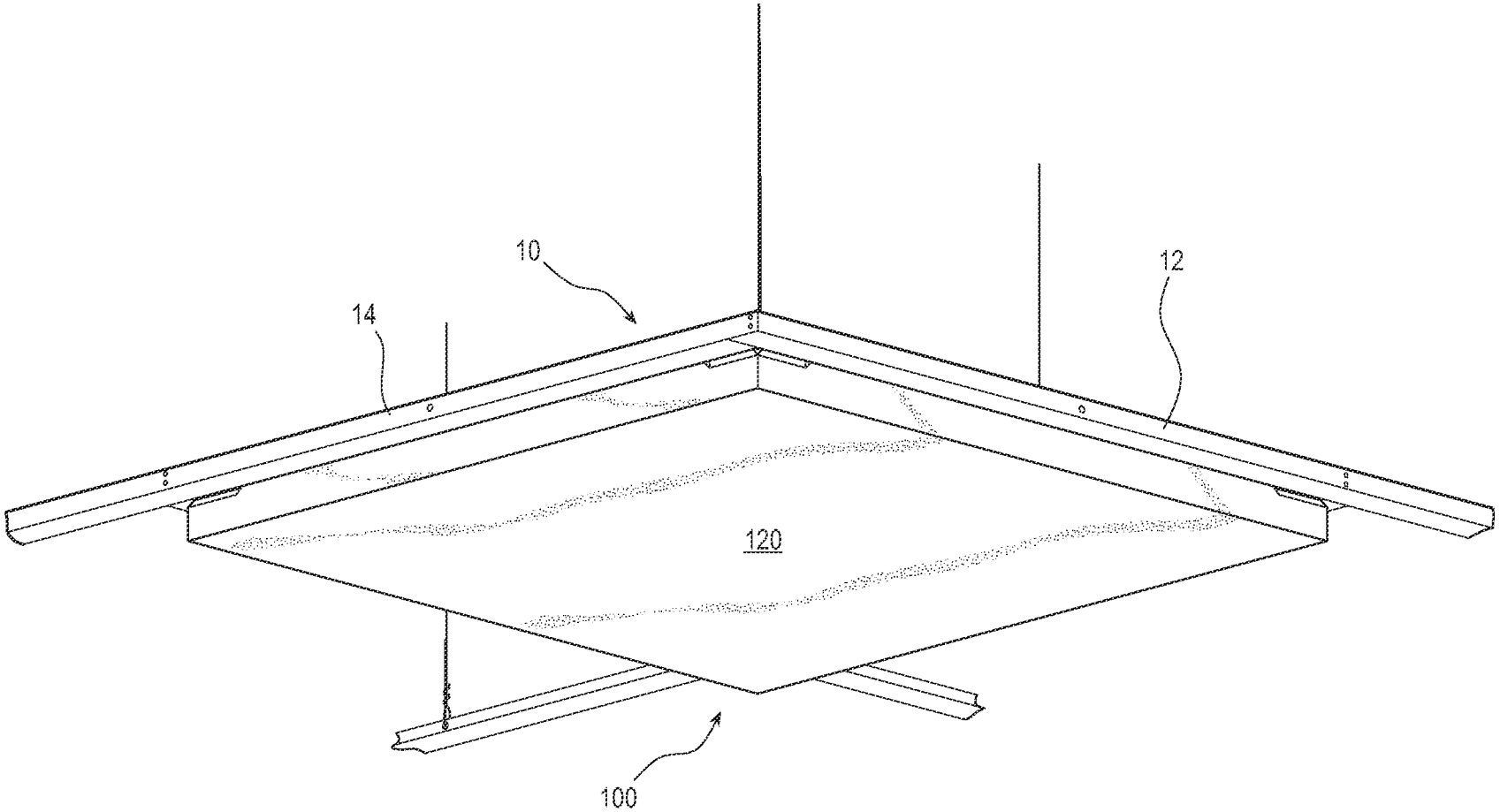
FIG. 6 is a perspective view of an acoustic system with an acoustic panel coupled to a suspension system.
Figure 7:
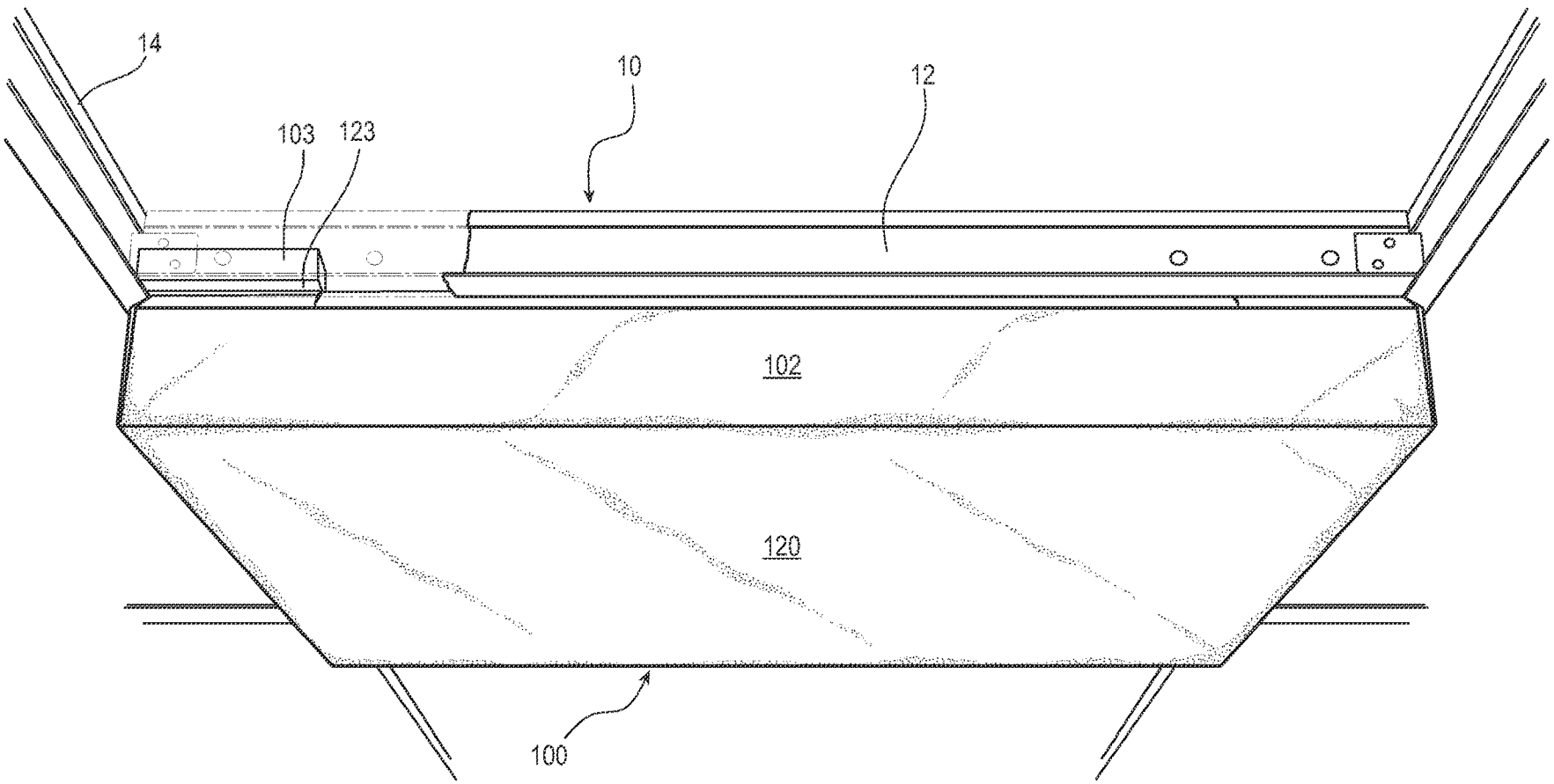
FIG. 7 is another perspective view of an acoustic system with an acoustic panel coupled to a suspension system.

With reference to FIGS. 5-7, during installation, the acoustic panels 100 can be inserted into an opening 20 in the grid and coupled to the structure 10. In an exemplary embodiment, a method of installation comprises a step of assembling the acoustic panel 100 by folding and transitioning the sidewalls 102, 104, 106, 108 from an unassembled configuration (as shown in FIGS. 1-3) to an assembled configuration (as shown in FIG. 4). Adhesives (e.g., glues) and other mechanical hardware need not be used. In the assembled configuration, the sidewalls 102, 104, 106, 108 can be biased towards the unassembled configuration, such that the sidewalls 102, 104, 106, 108 exhibit an outward force as they want to resume their planar or flat configuration. This bias or force can be advantageous in coupling to the grid.

With the sidewalls 102, 104, 106, 108 folded into the assembled configuration, the method can further comprise a step of coupling the acoustic panel 100 to a building structure. In some embodiments, the coupling step comprises coupling the acoustic panel 100 to a ceiling, wall, or suspension system 10. In doing so, the extension members 103, 105, 107, 109 can be inserted into an opening in the building structure, such as the opening 20 of the grid depicted in FIGS. 5-7. For example, the extension members 103, 105, 107, 109 can be non-rigid such that they can be urged inwards during insertion into the opening 20. After the extension members 103, 105, 107, 109 are pushed past the one or more rails or runners 12, 14 such that the rails or runners 12, 14, are disposed within the connection interfaces 123, 125, 127, 129, the extension members 103, 105, 107, 109 can bias back towards a position that is substantially parallel with the sidewalls 102, 104, 106, 108 and perpendicular from the base 111 to hold the acoustic panel 100 in position, as shown in FIG. 6.

FIG. 7 illustrates an exemplary acoustic panel 100 coupled to the grid, showing a cutaway of a portion of the rail or runner 12. As shown therein, a portion of the rail or runner 12 is disposed within or otherwise engaged with the connection interface 123 and below the extension member 103 thereby retaining the acoustic panel 100 in the structure 10. Further, as mentioned above, the sidewalls 102, 104, 106, 108 may bias towards the unassembled configuration, causing the connection interface 123, 125, 127, 129 to exhibit a force on the rails or runners 12, 14 and aid in retaining the acoustic panel 100 in position. No adhesives (e.g., glue) or other mechanical hardware is thus required for coupling the acoustic panel 100 to the rail or runner 12, 14, although adhesives (e.g., glue) and/or other mechanical hardware can be optionally used if desired.

In similar fashion, a plurality of acoustic panels 100, 200, 300, 400 can be coupled to a building structure 10 as shown in FIG. 8. In particular, FIG. 8 shows a four panels 100, 200, 300, 400 coupled to the runners 12, 14 of a building structure 10. As shown in FIG. 8, the height of the panels 100, 200, 300, 400 can also be varied to achieve a desired visual or aesthetic appeal.

Figure 9:
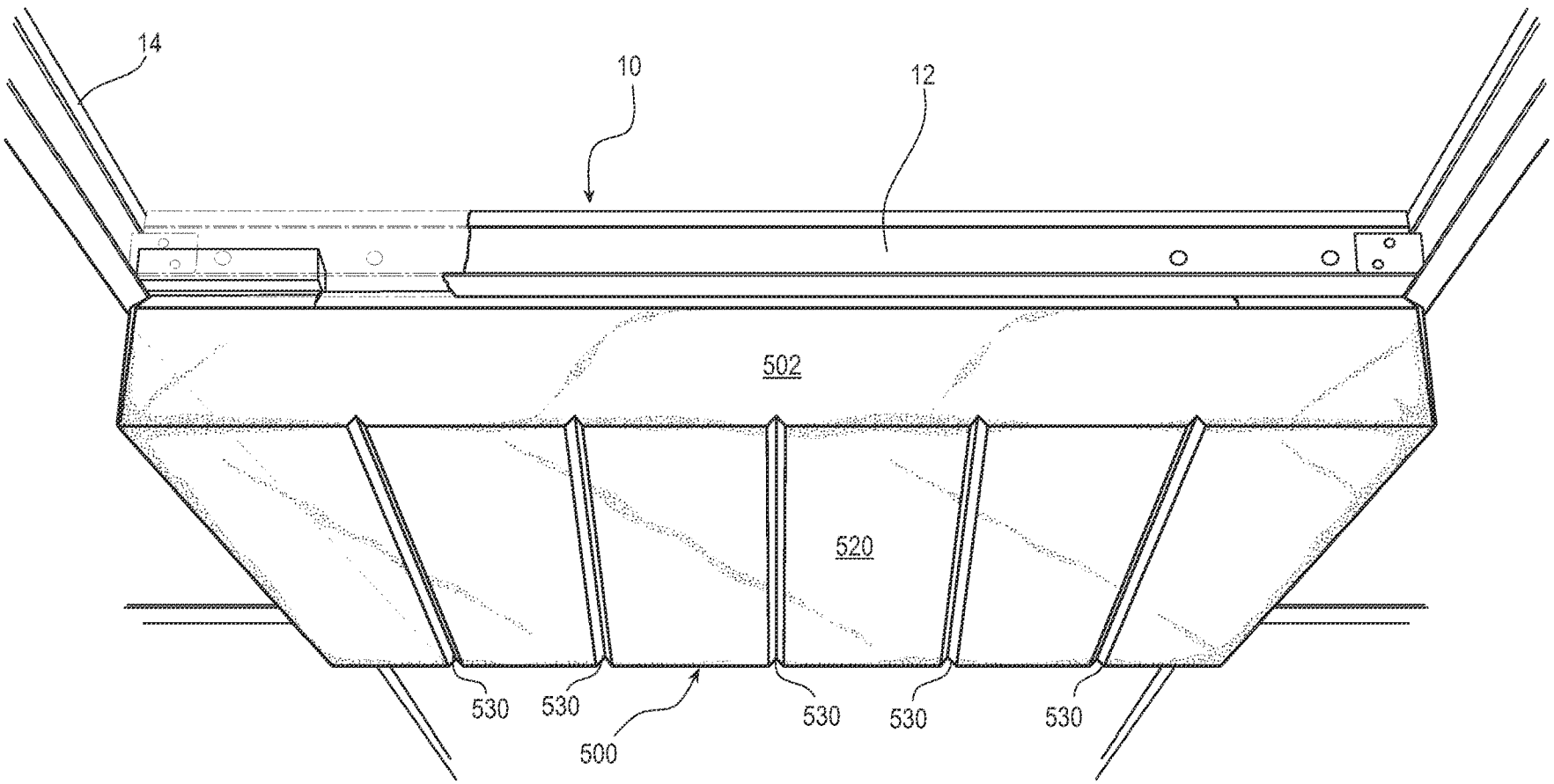
FIG. 9 is a perspective view of another acoustic system with an acoustic panel coupled to a suspension system.
Figure 10:
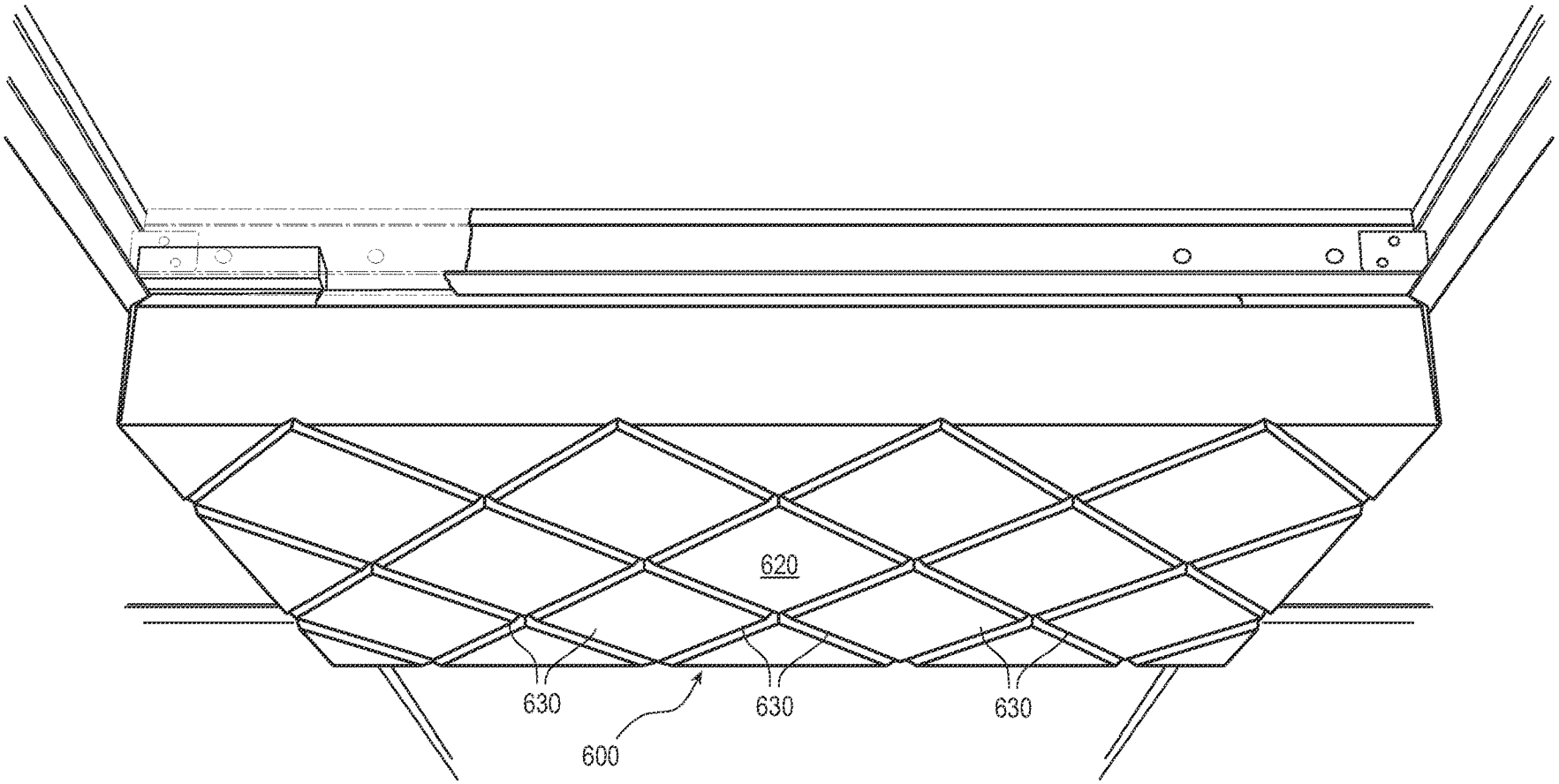
FIG. 10 is a perspective view of another acoustic system with an acoustic panel coupled to a suspension system.
Figure 11:
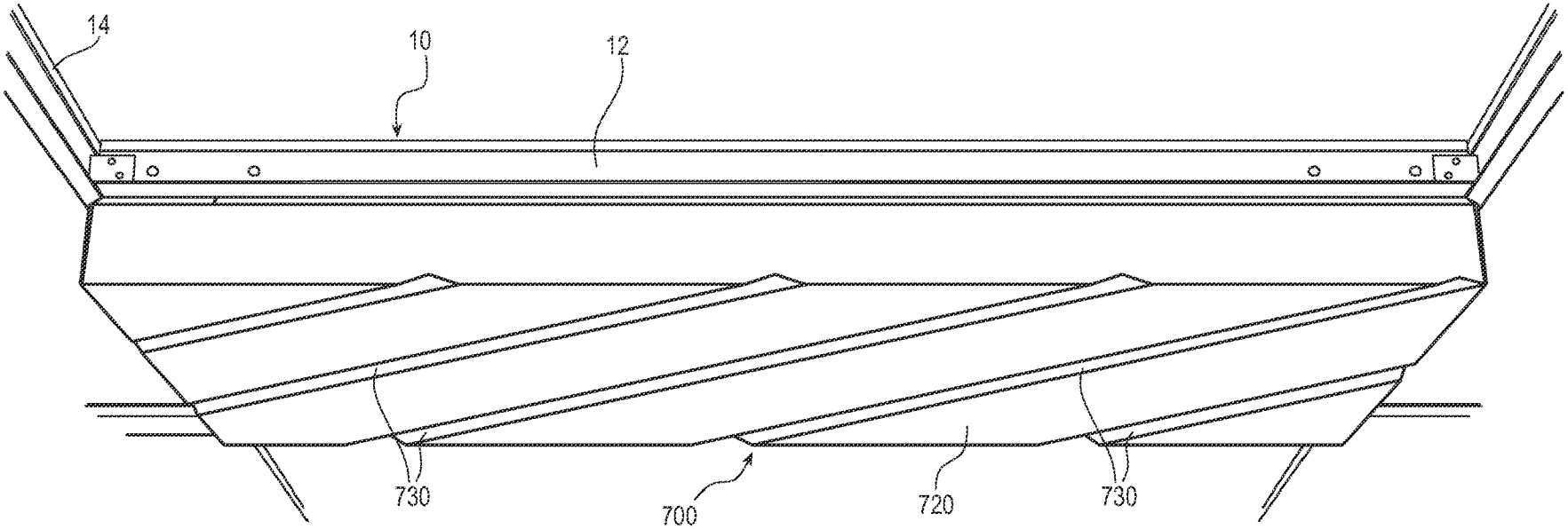
FIG. 11 is a perspective view of another acoustic system with an acoustic panel coupled to a suspension system.

A desired visual or aesthetic appeal can also be achieved by imparting design features to the panels. FIGS. 9-11 depict additional embodiments of the acoustic panels 500, 600, 700, each having a different variety of design features. For instance, FIG. 9 illustrates an exemplary acoustic panel 500 coupled to rails or runners 12, 14 of a suspension system 10 according to one embodiment. As shown therein, the acoustic panel 500 includes one or more design features 530 disposed on a side or surface 520 of the acoustic panel 500. In some embodiments, the design features 530 comprise score lines or cutouts in the side or surface 520 of the acoustic panel 500. In certain of such embodiments, the score lines or cutouts comprise a substantially V-shaped, U-shaped, or rectangular-shaped cross-section. Other types and/or shapes of design features 530 can also be used. In certain embodiments, the design features 530 are only disposed on one side or surface 520 of the acoustic panel 500. For instance, the design features 530 may be disposed on a surface that is visualized and/or viewed when the acoustic panel 500 is coupled to a structure 10. In certain embodiments, the design features 530 are also shown to not extend to the sidewalls 502 of the side or surface, although the design features 530 can extend along the sidewalls 502 of the side or surface if desired.

Any variety of design features 530 can be used. In the illustrated embodiment, the design features 530 comprise linear lines or grooves extending across the side or surface 520 of the acoustic panel 500. Other design features 530 are also contemplated, including non-linear lines, arcs, curved lines, patterns, etc. Further, the design features 530 can extend in one or more directions, including, but not limited to, laterally across the acoustic panel 500, longitudinally across the acoustic panel 500, and/or diagonally across the acoustic panel 500 as desired.

FIGS. 10 and 11 depict additional embodiments of acoustic panels 600, 700 having design features 630, 730. In particular, FIG. 10 illustrates an acoustic panel 600 having diamond-shaped design features 630 imparted to a side or surface 620 of the acoustic panel 600. FIG. 11 illustrates an acoustic panel 700 having design features 730 comprising linear lines that extend diagonally across a side or surface 720 of the acoustic panel 700. Further, the acoustic panel 700 of FIG. 11 is also an elongated rectangle in shape rather than square. It will thus be appreciated that any variety of design features can be applied to a side or surface (e.g., a visual side or surface) of the acoustic panels to achieve a desired visual or aesthetic appeal. It will also be appreciated that various sizes and/or shapes of acoustic panels can be used.

Methods of using and/or making an acoustic system are also disclosed herein. In particular, it is contemplated that any of the components, principles, and/or embodiments discussed above may be utilized in either an acoustic system or a method of using and/or making the same.

It will be appreciated that any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. All ranges include both endpoints.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

The invention claimed is:

1. An acoustic panel comprising:

a base;

a plurality of sidewalls coupled to the base;

a plurality of hinges coupling the sidewalls to the base; and a plurality of connection interfaces configured to couple the acoustic panel to a building structure;

wherein the acoustic panel comprises a unassembled configuration and an assembled configuration, wherein the acoustic panel is substantially planar in the unassembled configuration and wherein the sidewalls are oriented perpendicular to the base in the assembled configuration;

wherein each hinge comprises a cutout formed in a first side in the acoustic panel that extends partially through the acoustic panel; and wherein each connection interface comprises a cutout formed in a second side of the acoustic panel opposite the first side that partially extends through the acoustic panel.

2. The acoustic panel of claim 1, wherein the hinges are living hinges.

3. The acoustic panel of claim 1, wherein the cutout of each hinge comprises a V-shaped cross-section.

4. The acoustic panel of claim 3, wherein walls of the V-shaped cross-section are disposed at angles of between about 40 and about 50 degrees relative to the base.

5. The acoustic panel of claim 1, wherein each connection interface comprises a channel.

6. The acoustic panel of claim 1, wherein the acoustic panel comprises 4 sidewalls with each sidewall being perpendicular to two adjacent sidewalls in the assembled configuration, and wherein each connection interface aligns with and touches each connection interface of the two adjacent sidewalls in the assembled configuration.

7. The acoustic panel of claim 1, wherein the hinges extend along a longitudinal length of the sidewalls.

8. The acoustic panel of claim 1, wherein the acoustic panel is configured to be coupled to a grid structure.

9. The acoustic panel of claim 1, wherein a height of the acoustic panel is between about 2 inches and about 24 inches.

10. The acoustic panel of claim 1, wherein the base of the acoustic panel is substantially rectangular in shape.

11. The acoustic panel of claim 1, wherein each sidewall comprise a pair of extension members disposed on opposing ends of each sidewall, and wherein each connection interface of the plurality of connection interfaces are disposed at an upper edge of a corresponding sidewall and below the extension member.

12. A method of assembling an acoustic panel, comprising:

obtaining an acoustic panel in an unassembled configuration, the acoustic panel comprising:

a base;

a plurality of sidewalls;

a plurality of hinges; and a plurality of connection interfaces;

wherein each hinge comprises a cutout formed in a first side in the acoustic panel that extends partially through the acoustic panel;

wherein each connection interface comprises a cutout formed in a second side of the acoustic panel opposite the first side that partially extends through the acoustic panel; and wherein the acoustic panel in the unassembled configuration is substantially planar;

folding the plurality of sidewalls to transition the acoustic panel from the unassembled configuration to an assembled configuration.

13. The method of claim 12, wherein the hinges are living hinges.

14. The method of claim 12, wherein the cutout of each hinge comprises a V-shaped cross-section.

15. The method of claim 12, wherein each connection interface comprises a channel.

16. The method of claim 12, further comprising aligning each connection interface with connection interfaces on adjacent sidewalls.

17. A method of installing an acoustic panel, comprising:

obtaining an acoustic panel in an unassembled configuration, the acoustic panel comprising:

a base;

a plurality of sidewalls;

a plurality of hinges; and a plurality of connection interfaces;

wherein each hinge comprises a cutout formed in a first side in the acoustic panel that extends partially through the acoustic panel; and wherein each connection interface comprises a cutout formed in a second side of the acoustic panel opposite the first side that partially extends through the acoustic panel;

assembling an acoustic panel, comprising:

folding one or more sidewalls at the hinge of each sidewall from an unassembled configuration to an assembled configuration;

coupling the acoustic panel to a building structure, comprising:

inserting a portion of the acoustic panel in an opening of a grid, and coupling the grid to the connection interface of the acoustic panel.

18. The method of claim 17, wherein the grid comprises a plurality of runners, and wherein coupling the grid comprising disposing a runner within the connection interface.

19. The method of claim 17, comprising:

assembling a second acoustic panel; and coupling the second acoustic panel to the building structure, wherein a height of the second acoustic panel differs from a height of the acoustic panel.

20. The method of claim 17, further comprising aligning each connection interface with connection interfaces on adjacent sidewalls.

* * * * *